US009284961B2

(12) United States Patent
Mashima et al.

(10) Patent No.: US 9,284,961 B2
(45) Date of Patent: Mar. 15, 2016

(54) FAN DEVICE

(71) Applicant: MINEBEA CO., LTD., Kitasaku-gun, Nagano (JP)

(72) Inventors: Takayuki Mashima, Kitasaku-gun (JP); Yoichi Kawai, Kitasaku-gun (JP)

(73) Assignee: MINEABEA CO., LTD., Kitasaku-gun (JP)

( * ) Notice: Subject to any disclaimer, the term of this patent is extended or adjusted under 35 U.S.C. 154(b) by 422 days.

(21) Appl. No.: 13/750,472

(22) Filed: Jan. 25, 2013

(65) Prior Publication Data

US 2013/0195634 A1 Aug. 1, 2013

(30) Foreign Application Priority Data

Jan. 30, 2012 (JP) ..... 2012-016255

(51) Int. Cl.
*F04D 29/66* (2006.01)
*F04D 19/00* (2006.01)
*F04D 25/06* (2006.01)

(52) U.S. Cl.
CPC ..... *F04D 19/002* (2013.01); *F04D 25/0613* (2013.01); *F04D 29/662* (2013.01)

(58) Field of Classification Search
CPC . F04D 29/662; F04D 25/0613; F04D 19/002; F04D 17/16; F05B 2260/96; F05B 2260/966
USPC ..... 415/119; 416/144–145, 500
See application file for complete search history.

(56) References Cited

U.S. PATENT DOCUMENTS

2005/0249596 A1* 11/2005 Hsieh ..... 416/144
2006/0269412 A1* 11/2006 Yu et al. ..... 416/144
2008/0056899 A1* 3/2008 Jiang et al. ..... 416/186 R
2008/0063526 A1* 3/2008 He ..... 416/144
2008/0075596 A1 3/2008 Kitamura
2009/0269195 A1* 10/2009 Hsu et al. ..... 415/208.2
2010/0074752 A1* 3/2010 Denis et al. ..... 416/144

FOREIGN PATENT DOCUMENTS

DE 10 2006 057 087 B3 * 6/2008 ..... F04D 29/28
DE 20 2010 013 785 U1 * 2/2011 ..... F04D 29/66
JP H04-35912 A 2/1992
JP A-2001-298925 10/2001

(Continued)

OTHER PUBLICATIONS

Machine Translation of DE 20 2010 013 785 U1, Feb. 17, 2011.*

(Continued)

*Primary Examiner* — Christopher Verdier
(74) *Attorney, Agent, or Firm* — Oliff PLC

(57) ABSTRACT

A fan device includes a rotor 20 and recesses 40 to be filled with claylike weights 70. The rotor 20 includes an impeller 23 and a shaft 10. The impeller 23 has a hub 21 and vanes 22. The recesses 40 are provided on a surface 212 that crosses an axial direction of the hub 21. Each recess 40 has a first area 41 and a second area 42. The first area 41 is circumferentially arranged and extends in a substantially circumferential direction. The second area 42 is connected to an outer circumferential side of the first area 41 and has a shorter length in the circumferential direction than the first area 41. The weight 70 is closely adhered to wall surfaces 421 and 422 formed along a radial direction in the second area 42 so as to prevent separation thereof.

10 Claims, 5 Drawing Sheets

(56) References Cited

FOREIGN PATENT DOCUMENTS

| | | | |
|---|---|---|---|
| JP | 3121953 | U | 6/2006 |
| JP | 2006-322325 | A | 11/2006 |
| JP | A-2008-082212 | | 4/2008 |
| JP | A-2010-025087 | | 2/2010 |

OTHER PUBLICATIONS

Sep. 16, 2015 Office Action issued in Japanese Application No. 2012-016255.

* cited by examiner

FAN DEVICE

BACKGROUND OF THE INVENTION

1. Field of the Invention

The present invention relates to a fan device in which a motor rotates an impeller to generate an air flow so as to blow the air.

2. Description of Related Art

For example, electronic devices equipped with electronic components, such as personal computers and office equipment, have small fan devices for cooling the interior of the housing thereof and the electronic components. The fan devices include axial-flow fan devices and centrifugal fan devices. In these kinds of fan devices, since physical imbalance of the rotor with respect to the rotating shaft commonly occurs, a rotational balance adjustment of the rotor is performed so that the amount of the rotational imbalance is approached to zero as much as possible. In particular, in order to improve the cooling performance in response to an increase in the amount of heat generation associated with increasing performance of electronic devices, the fan devices are required to rotate at higher speed. In this regard, the rotational imbalance during the high speed rotation causes an increase of noise, and therefore, the adjustment of the rotational balance is an essential matter.

In general, the rotational balance of the rotor is adjusted by attaching a balance weight at a position axially opposite to the position of rotational imbalance in a circumferential direction of the rotor so as to balance the rotation. As the balance weight, a metal clip to be attached to the rotor may be used (disclosed in Japanese Patent Application Laid-open No. 2008-082212). Alternatively, a claylike weight that has appropriate consistency and adhesiveness and is fixed by curing, such as balancing putty, may be used (disclosed in Japanese Patent Applications Laid-open Nos. 2010-025087 and 2001-298925).

In the case of using a balancing putty, recesses (disclosed in Japanese Patent Application Laid-open No. 2010-025087) or grooves (disclosed in Japanese Patent Application Laid-open No. 2001-298925) may be formed on an end surface of a hub that forms the rotor. Then, the recesses or the grooves are filled with a required amount of the putty and the rotational balance is thereby adjusted. For example, a recess 80 with an approximately rectangular shape as shown in FIG. 8 is formed on the end surface of the hub, and a claylike weight 70 such as putty is attached in the recess 80. As shown in FIG. 8, when the amount of the weight 70 is relatively smaller than the inner volume of the recess 80, the weight 70 is attached on the outer circumferential side of the recess 80 in a direction indicated by arrow B in FIG. 8 so as to avoid the separation and drop of the weight 70 due to centrifugal force.

In order to attach the putty-like weight 70 on the outer circumferential side of the recess 80 as described above, the following procedure is used. That is, as shown in FIG. 9A, the weight 70 is placed on an end of a spatula 90, and the spatula 90 is inserted in the recess 80 so that the weight 70 faces the outer circumferential side (left side in FIGS. 9A to 9C). Then, as shown in FIGS. 9B and 9C, the spatula 90 is pulled out from the recess 80 while being pressed against an edge on the outer circumferential side of the recess 80. Accordingly, the weight 70 is adhered to the outer circumferential side of the recess 80, from the wall surface to the bottom.

Even when the amount of the weight 70 is small, the separation and drop of the weight 70 caused by the centrifugal force working in the axial direction can be prevented if the weight 70 is adhered to the wall surface at the outer circumferential side of the recess 80 as shown in FIG. 8. However, the weight 70 also tends to separate and drop due to inertial force generated in tangential direction when the rotor is started or stopped. This problem could be solved by reducing the length of the recess 80 in the circumferential direction (direction indicated by arrow A in FIG. 8) so that the weight 70 is adhered also to side wall surfaces that are in a direction crossing the circumferential direction of the recess 80. Nevertheless, as shown in FIGS. 9A to 9C, the recess 80 must be long enough in the circumferential direction to allow the spatula 90 be inserted. Therefore, if the amount of the weight 70 is relatively small, the weight 70 will not adhere to the side wall surfaces and the separation and drop of the weight 70 may easily occur. Moreover, the weight 70 is applied in uncured state when the rotational balance of the rotor is adjusted as a part of a production process. Consequently, the weight 70 may easily separate and drop due to the inertial force that is generated when the rotor is started or stopped to rotate for inspection. Even in the case of attaching the claylike weight in the groove as disclosed in Japanese Patent Application Laid-open No. 2001-298925, there is no preventive measure with respect to the inertial force in the circumferential direction, and the weight may easily separate and drop.

SUMMARY OF THE INVENTION

The present invention has been completed in view of these circumstances, and it is a primary object of the present invention to provide a fan device with a rotor that is provided with recesses in which balance weights may be attached. In the fan device according to the present invention, the separation and drop of the balance weights from the recesses while or after rotational balance is adjusted is effectively prevented.

The present invention provides a fan device provided with a rotor including an impeller having a hub with vanes arranged at the outer circumferential portion of the hub and a shaft provided at a center of the hub for supporting the rotor rotatable around the shaft. The rotor is provided with at least one recess in which a balance weight may be attached. The recess has a first area and a second area. The first area is circumferentially arranged around the shaft as a center and extends in an approximately circumferential direction. In other words, the first area is located on a circumference having the shaft as the center. The second area is connected to the first area and has a shorter length in the circumferential direction than the first area.

According to the present invention, the recess formed on the rotor for attaching a balance weight has the first area, and the second area that has a shorter length in the circumferential direction than the first area. By attaching a balance weight to the second area, the balance weight is closely adhered to a wall surface extending in a direction crossing the circumferential direction of the second area. Accordingly, when inertial force is generated, the force that is applied on the balance weight is supported by the wall surface extending in the direction crossing the circumferential direction of the second area, whereby the balance weight does not easily separate and drop from the recess.

In the present invention, the recesses may be formed on a surface that crosses the axial direction of the rotor. In this case, the above effects can be effectively obtained.

In the present invention, the recesses may be formed on a surface that is parallel to the axial direction of the rotor. In this case, the above effects also can be effectively obtained.

In the fan device of the present invention, the balance weight may be attached to at least one second area.

According to the present invention, a fan device, in which the separation and drop of the balance weight attached in the recess provided on the rotor is effectively prevented during and after rotational balance adjustment, is provided.

PREFERRED EMBODIMENT OF THE INVENTION

The first embodiment of the present invention will be described with reference to the figures hereinafter. The housing of the fan device is not shown explicitly in the figures because the housing is indifferent for the present invention and any housing can be used.

Figure 1:
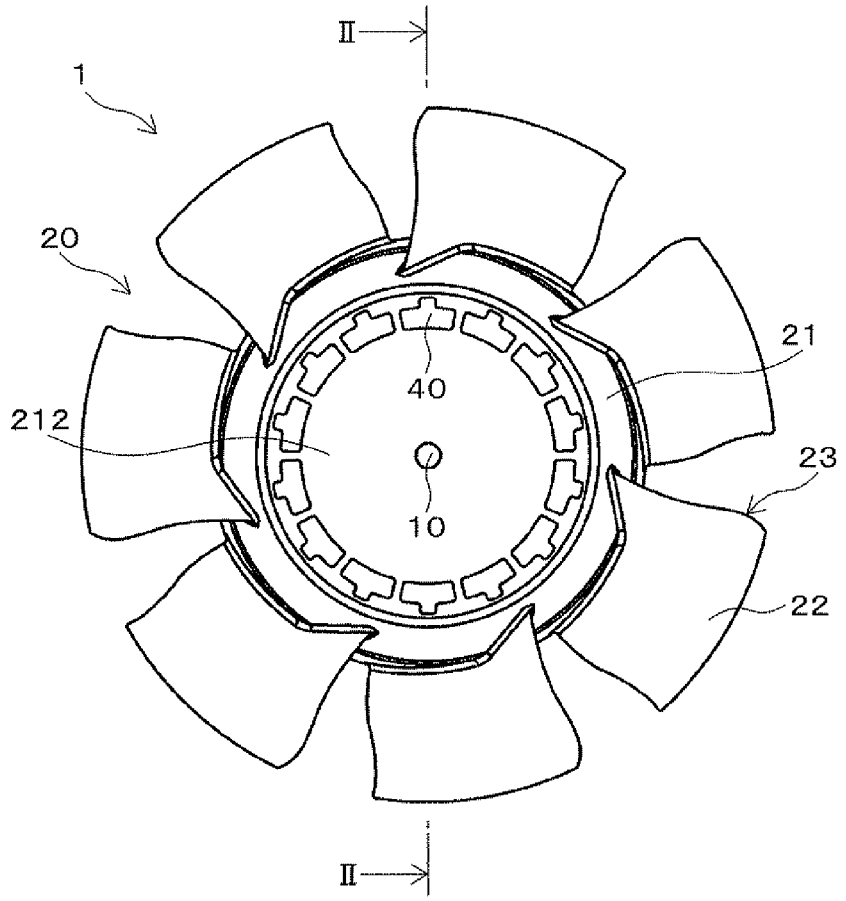
FIG. 1 is a top view of a fan device according to the first embodiment of the present invention.
Figure 2:
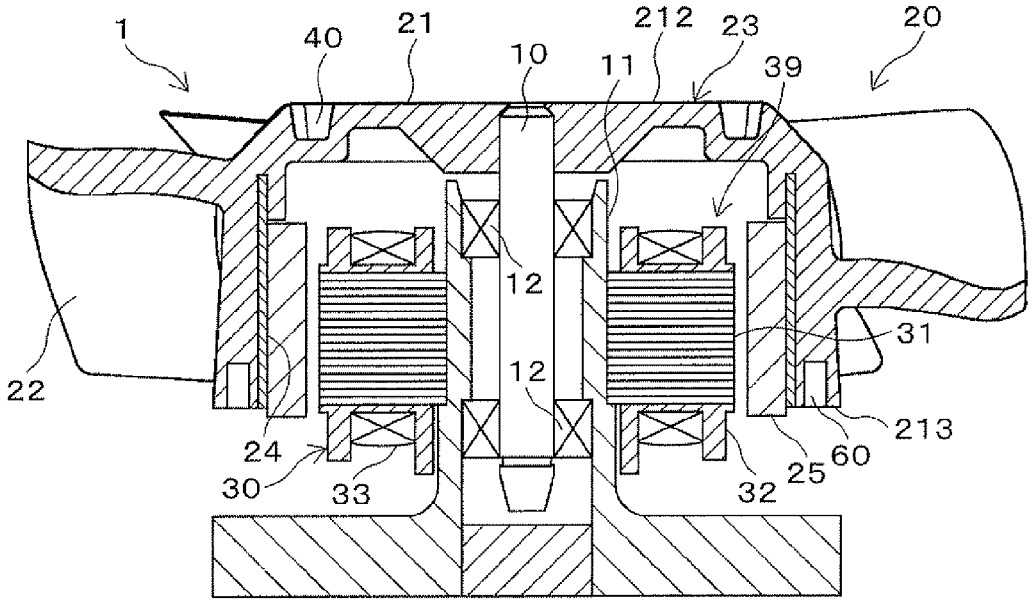
FIG. 2 is a cross sectional view on arrows II-II in FIG. 1.

FIG. 1 is a top view of an axial-flow fan device 1 according to the first embodiment. FIG. 2 is a cross sectional view on arrows II-II in FIG. 1. The reference numeral 10 indicates a shaft in FIGS. 1 and 2. As shown in FIG. 2, the shaft 10 is rotatably supported by a bearing holder 11 via bearings 12 such as ball bearings. The shaft 10 has an end (an upper end in FIG. 2) to which a center of a hub 21 is fixed. The hub 21 forms a rotor 20 and is made of synthetic resin. The shaft 10 is coaxially fixed to the center of the hub 21 by insert molding.

The hub 21 is formed into a cup shape and has an outer circumferential surface that is integrally formed with plural axial-flow vanes 22 and thereby forms an impeller 23. The hub 21 has an inner circumferential surface to which a yoke 24 is fixed. The yoke 24 has an inner circumferential surface to which a rotor magnet 25 that is a permanent magnet is fixed. The rotor 20 is composed of the shaft 10, the impeller 23 in which the vanes 22 are formed at the outer circumferential portion of the hub 21, the yoke 24, and the rotor magnet 25.

The rotor 20 is contained in a ventilation path in a housing (not shown in the figures). The housing is integrally fixed to the bearing holder 11. The bearing holder 11 has an outer circumferential surface to which a stator 30 is arranged and is fixed so as to face the rotor magnet 25 with a space therebetween. The stator 30 is composed of a core 31 that radially extends toward the rotor magnet 25, an insulator 32 that is fitted to the core 31, and a coil 33 that is wound to the insulator 32, and the stator 30 is contained in the hub 21. The stator 30 and the rotor magnet 25 form a motor 39 for rotationally driving the rotor 20. A circuit board (not shown in the figure) for controlling the rotational drive of the rotor 20 is arranged on a lower side of the stator 30 in FIG. 2.

In the motor 39, electric current is supplied to the coil 33 via the circuit board and is controlled by a driving circuit on the circuit board, whereby the core 31 is sequentially excited, and the rotor 20 rotates around the shaft 10 in a predetermined direction. When the rotor 20 rotates in the predetermined direction, the vanes 22 integrally rotate and generate airflow according to the rotation.

As shown in FIG. 2, the hub 21 has an upper end surface 212 consisting of a flat and circular end surface orthogonal to the axial direction of the shaft 10. The upper end surface 212 has an outer circumferential portion on which plural recesses 40 are formed in the circumferential direction.

Figure 3:
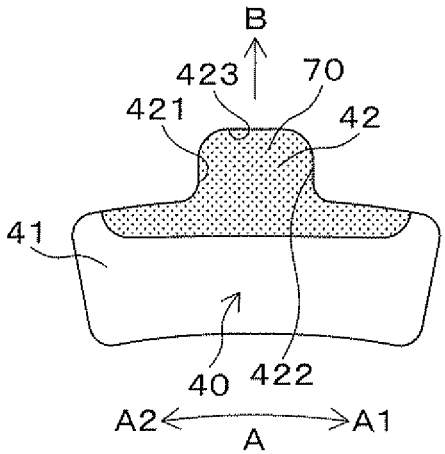
FIG. 3 is a top view of a recess of the first embodiment.

As shown in FIGS. 1 and 3, each recess 40 has a first area 41 and a second area 42. The first area 41 is concentrically arranged with respect to the upper end surface 212 of the hub 21 and has an approximately rectangular shape extending in the circumferential direction (direction A in FIG. 3). The second area 42 is connected to an outer circumferential side (side indicated by arrow B in FIG. 3) of the first area 41 and has a shorter length in the circumferential direction than the first area 41. The second area 42 is arranged in the middle of the first area 41 in the circumferential direction and is approximately perpendicular to the first area 41. The recesses 40 are formed at the entire circumference of the outer circumferential portion of the upper end surface 212 at equal interval in the circumferential direction.

The fan device 1 having the above-described structure may present rotational imbalance when the rotor 20 is rotated. In this case, elimination of the rotational imbalance, that is, adjustment of the rotational balance, must be performed. In order to adjust the rotational balance, firstly the rotor 20 is set on an imbalance-measuring device for measuring the amount of imbalance of the rotating member, and the imbalance-measuring device is started. Then, the rotor 20 is rotated and the amount of rotational imbalance and the position that causes the imbalance of the rotor 20 are measured by the imbalance-measuring device.

Next, according to the detected amount of the rotational imbalance and the detected position that causes the imbalance, a balance weight is adhered to the necessary position in the circumferential direction of the rotor 20, that is, to the recess 40 located at axisymmetric position in relation to the detected position. Then, the amount of the rotational imbalance is measured again in the condition in which the balance weight is adhered. The amount of the balance weight is repeatedly adjusted until the amount of the rotational imbalance falls within a predetermined specification. Finally, when an appropriate amount of the balance weights is adhered to the inside of the recesses 40, the adjustment is finished.

Figure 9A:
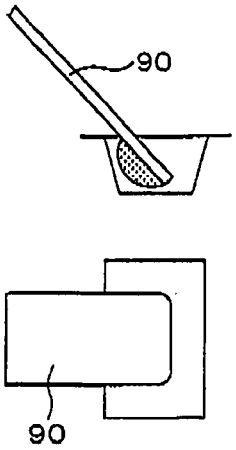
Fig. 9A Related Art
FIGS. 9A to 9C are side views that shows the steps for attaching a claylike weight such as a putty to a conventional recess.
Figure 9B:
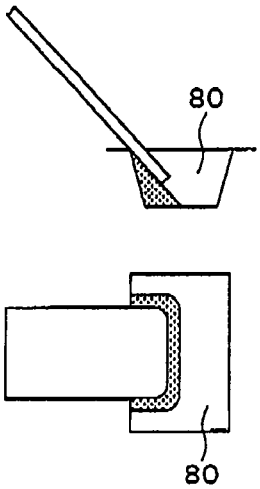
Fig. 9B Related Art
Figure 9C:
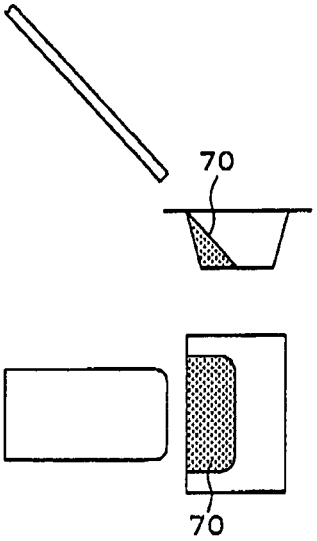
Fig. 9C Related Art

As the balance weight, a claylike weight 70 such as a balancing putty is preferably used in this embodiment. The balancing putty may be a curable resin which has an appropriate consistency and adhesiveness when adhered to the recess 40 in uncured state, and hardens and fixes firmly by curing after it is adhered. Examples of curable resin are a two part epoxy compound which starts to cure after mixing two components or a thermosetting resin which is cured by heating it. The weight 70 is attached by being adhered to a wall surface on the outer circumferential side of the recess 40 with a spatula 90 as shown in FIGS. 9A to 9C. Therefore, as shown in FIG. 3, the length of the first area 41 of the recess 40 in the circumferential direction is set to be greater than the width of the spatula 90 so that the spatula 90 can be inserted therein. On the other hand, the second area 42 should have a width smaller than the spatula 90.

With this configuration, even when the necessary amount of the weight 70 is small compared to the entire inner volume of the recess 40, the second area 42 on the outer circumferential side is filled with most of the weight 70, and the rest of the weight 70 is contained in the first area 41, as shown in FIG. 3. By thus filling the second area 42 with the weight 70, the weight 70 is closely adhered to both wall surfaces 421 and 422 along the radial direction of the second area 42.

When the rotor 20 is rotated for the adjustment of the rotational balance, centrifugal force generated by the rotation of the rotor 20 is applied to the weight 70. Therefore, since the weight 70 is placed to the outer circumferential side of recess 40, the weight 70 closely adheres to the wall surfaces on the outer circumferential side in the recess 40. Accordingly, the separation and drop of the weight 70 is prevented even when the weight 70 is not cured.

On the other hand, in addition to the centrifugal force, inertial force in a direction tangent to the circumferential direction is generated in the weight 70 when the rotation of the rotor 20 is started or stopped. In this case, acceleration generated in the weight 70 is supported by the wall surfaces 421 and 422 extending along the radial direction in the second area 42 that is filled with the weight 70. That is, if the rotation direction of the rotor 20 during the rotational balance adjustment is the direction indicated by arrow A1 in FIG. 3, the inertial force is generated in the direction indicated by arrow A2 when the rotor 20 is started. Therefore, the weight 70 is supported by the wall surface 421 in the second area 42. On the other hand, since the inertial force is generated in the direction indicated by the arrow A1 when the rotor 20 is stopped, the weight 70 is supported by the wall surface 422 in the second area 42. Accordingly, even when the inertial force is generated in a condition in which the weight 70 is not cured, the weight 70 does not separate and drop easily from the recess 40.

After the rotational balance of the rotor 20 is adjusted and the weight 70 is cured, the weight 70 adheres firmly to the inside of the second area 42. In particular, the weight 70 adheres to the wall surface 423 at the outer circumferential side, which receives the centrifugal force, and adheres to the wall surfaces 421 and 422 along the radial direction, which receive the inertial force. Therefore, the separation and drop of the weight 70 from the recess 40 is prevented. The separation and drop is more effectively prevented by setting the amount of the weight 70 that fills the second area 42 so that the weight 70 contacts both wall surfaces 421 and 422 along the radial direction.

Figure 4A:
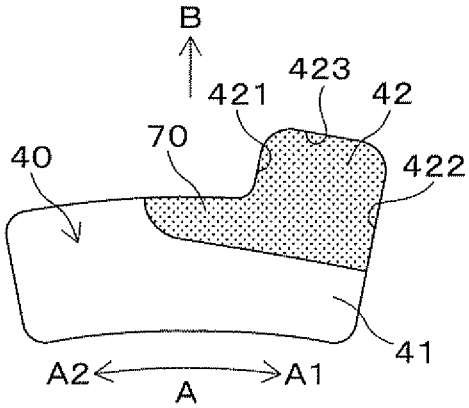
FIGS. 4A and 4B are top views of modifications of a recess.
Figure 4B:
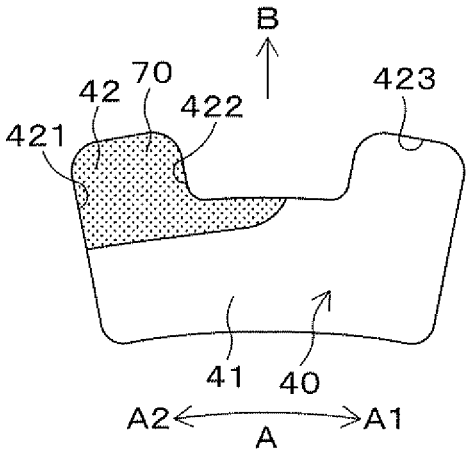

As long as the second area 42 is formed at the outer circumferential side of the recess 40 with a length in circumferential direction shorter than that of the first area 41, the number and the relative position of the second area 42 in the circumferential direction with respect to the first area 41 are not limited. For example, as shown in FIG. 4A, the second area 42 may be formed on an extremity of the first area 41, and the weight 70 may be attached to the inside of the second area 42. Furthermore, as shown in FIG. 4B, the second area 42 may be formed on both extremities of the first area 41. In this case, at least one of the second areas 42 is filled with the weight 70, and there may be a case in which the other second area 42 is filled with an appropriate amount of the weight 70 as necessary. The advantage of the first embodiment of the present invention in relation to a conventional structure is that, although the recess 40 has a width sufficient to insert a spatula, the separation and drop of the weight 70 is prevented by filling the second area 42 with the weight 70.

Figure 5:
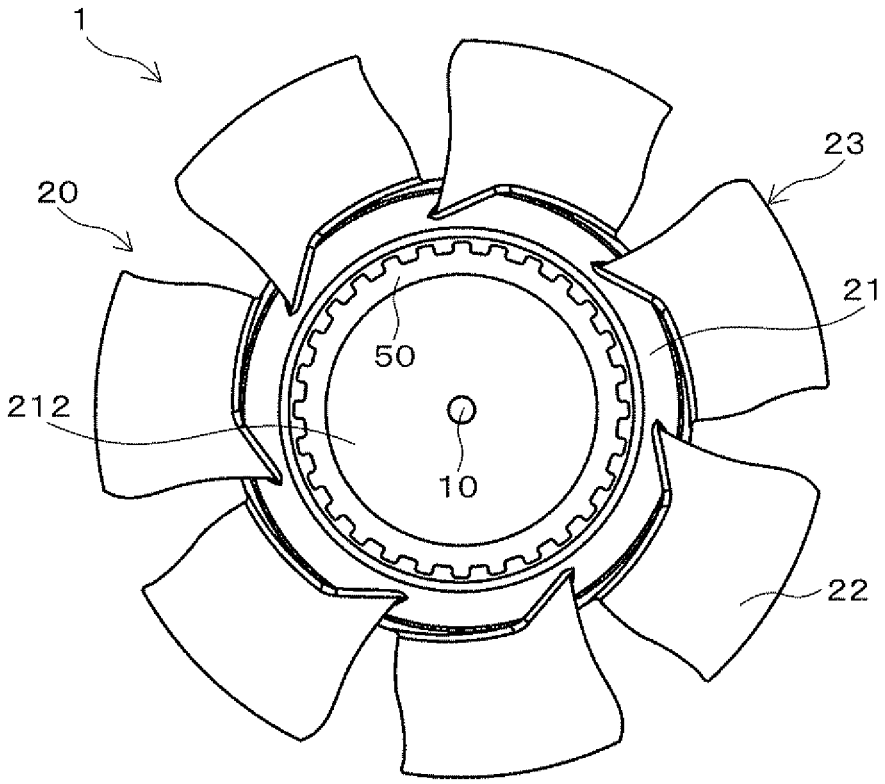
FIG. 5 is a top view of a fan device according to the second embodiment of the present invention.

FIG. 5 is a top view of an axial-flow fan device according to the second embodiment of the present invention. The second embodiment has the same structural components as the first embodiment except for the structure of the recess that is formed on the upper end surface 212 of the hub 21. Accordingly, the same structural components as those of the first embodiment have the same reference number as in the case of the first embodiment, and descriptions thereof are omitted.

The second embodiment has a recess 50 in which a first area 51 along the circumferential direction is an annular area continuously formed in the entire circumference. In other words, the single annular first area 51 is located on a circumference having the shaft as a center. Plural second areas 52 are connected to the first area 51 so as to protrude radially from the outer circumferential side of the first area 51 at equal interval. Therefore, each of the second areas 52 has a shorter length in the circumferential direction than the first area 51.

Figure 6:
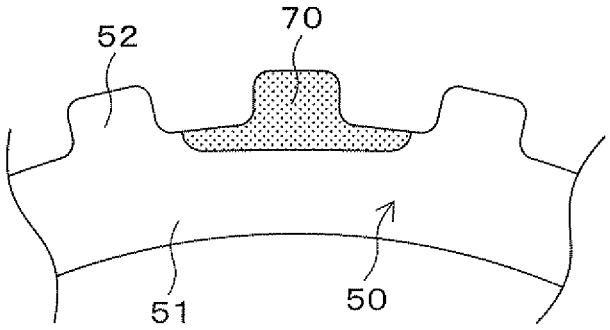
FIG. 6 is a top view of a recess of the second embodiment.

In the second embodiment, as shown in FIG. 6, the rotational balance of the rotor 20 is adjusted, for example, by filling the second area 52 at a position for correcting the rotational imbalance with most of the weight 70, and putting the rest of the weight 70 in the first area 51. The weight 70 may be applied in one second area 52 or in plural adjacent second areas 52 according to the amount of the weight 70 required for correcting the rotational imbalance. Needless to say, the same is also true for the first embodiment.

Figure 7:
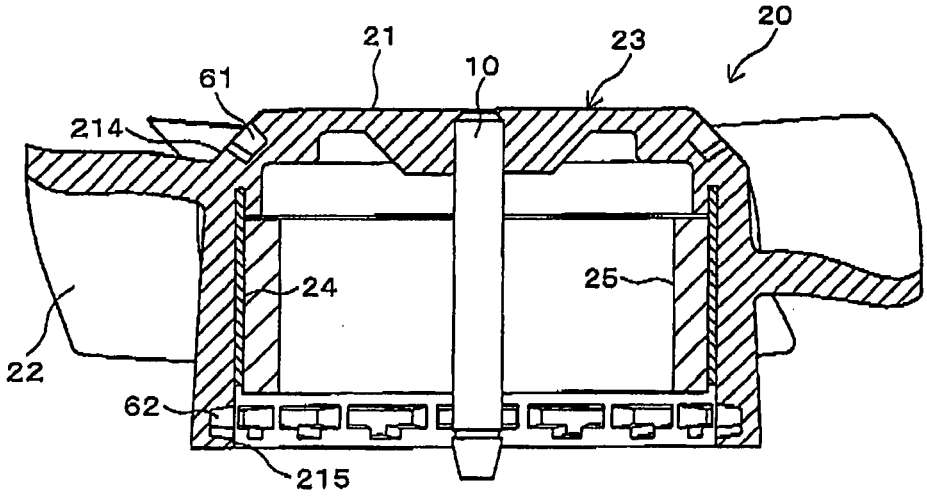
FIG. 7 is a cross sectional view of a rotor according to the second embodiment of the present invention.
Figure 8:
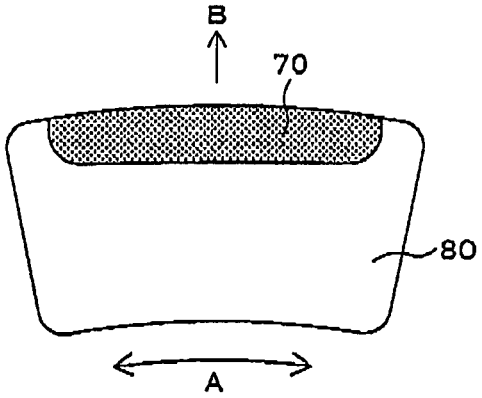
Fig. 8 Related Art
FIG. 8 is a top view of a conventional recess in a condition in which a claylike weight such as a putty is attached.

The recess 40 or 50 in each of the embodiments of the present invention may be formed on a circular lower end surface 213 of the hub 21 as shown in FIG. 2 other than the upper end surface 212 of the hub 21. The reference numeral 60 in FIG. 2 indicates a recess similar to the recess 40 or 50. Furthermore, as shown in FIG. 7, the recess 40 or 50 may be formed on a sloped surface 214 of the hub 21 which is inclined in relation to the axial direction. The reference numeral 61 in FIG. 7 indicates a recess similar to the recess 40 or 50. The lower end surface 213 and the sloped surface 214 are surfaces that cross the axial direction of the shaft 10.

Moreover, the recess 40 or 50 in each of the embodiments of the present invention may be formed on an inner circumferential surface 215 of the hub 21 as shown in FIG. 7. The reference numeral 62 indicates the recess 40 or 50 in FIG. 7. The inner circumferential surface 215 of the hub 21 is a surface that is parallel to the axial direction of the shaft 10.

In the present invention, the recess can be formed on a surface which crosses the axial direction of the hub 21, such as the upper end surface 212 or the lower end surface 213 on the opposite side of the upper end surface 212, or the sloped surface 214. Moreover, the recess may be formed on a surface that is parallel to the axial direction, such as the inner circumferential surface 215 or the outer circumferential surface of the hub 21.

The above-described embodiments are examples in which the present invention is applied to an axial-flow fan device, but the present invention may also be applied to other type of fan devices such as a centrifugal fan device.

What is claimed is:

1. A fan device comprising:

an impeller having a hub and vanes which are provided at an outer circumferential portion of the hub;

a shaft being provided at a center of the hub; and a rotor including the impeller and the shaft and being supported so as to be rotatable around the shaft, wherein the rotor is provided with plural recesses having a bottom, each of the plural recesses having a closed boundary, at least one of the plural recesses has a first area and at least one second area, the first area is located on a circumference having the shaft as a center and extends in a substantially circumferential direction, the second area is connected to the first area and has a shorter length in the circumferential direction than the first area, and wherein the first area and the second area are opened to an exposed surface of the rotor, wherein a balance weight is adhered to at least one of the plural recesses, the balance weight includes a second portion filling the second area and a first portion which is connected to the second portion and extends in the circumferential direction in the first area, and wherein the balance weight is a curable resin.

2. The fan device according to claim 1, wherein the plural recesses are formed on a surface that crosses an axial direction of the rotor.

3. The fan device according to claim 2, wherein the plural recesses are formed on an upper end surface of the hub.

4. The fan device according to claim 2, wherein the plural recesses are formed on a lowermost exposed end surface of the hub.

5. The fan device according to claim 2, wherein the plural recesses are formed on an outer surface of the hub inclined in relation to the axial direction.

6. The fan device according to claim 1, wherein the plural recesses are formed on a surface that is parallel to an axial direction of the rotor.

7. The fan device according to claim 6, wherein the plural recesses formed on an inner surface of the hub.

8. The fan device according to claim 1, wherein the curable resin is a thermosetting resin or a two part compound epoxy resin.

9. The fan device according to claim 1, wherein the second area is approximately perpendicular to the first area.

10. A fan device comprising:

an impeller having a hub and vanes which are provided at an outer circumferential portion of the hub;

a shaft being provided at a center of the hub; and a rotor including the impeller and the shaft and being supported so as to be rotatable around the shaft, wherein the rotor is provided with a recess having a bottom, the recess is formed by a single annular first area and a plurality of second areas protruding radially from the outer circumferential side of the single annular first area, a balance weight is adhered to the recess, the balance weight includes a second portion filling at least one of the plurality of second areas and a first portion which is connected to the second portion and extends in the circumferential direction in the first area, and the balance weight is a curable resin.

* * * * *